US008030238B2

(12) United States Patent
Spano' et al.

(10) Patent No.: US 8,030,238 B2
(45) Date of Patent: Oct. 4, 2011

(54) CATALYST AND PROCESS FOR THE PREPARATION OF ALKYLATED AROMATIC HYDROCARBONS

(75) Inventors: Guido Spano', Novara (IT); Stefano Ramello, Novara (IT); Gianni Girotti, Novara (IT); Franco Rivetti, Milan (IT); Angela Carati, Milan (IT)

(73) Assignees: Polimeri Europa S.p.A., Brindisi (IT); Eni S.p.A., Rome (IT)

( * ) Notice: Subject to any disclaimer, the term of this patent is extended or adjusted under 35 U.S.C. 154(b) by 1013 days.

(21) Appl. No.: 11/630,390

(22) PCT Filed: Jun. 21, 2005

(86) PCT No.: PCT/EP2005/006704

§ 371 (c)(1),
(2), (4) Date: Jan. 25, 2007

(87) PCT Pub. No.: WO2006/002805

PCT Pub. Date: Jun. 12, 2006

(65) Prior Publication Data

US 2007/0276173 A1 Nov. 29, 2007

(30) Foreign Application Priority Data

Jun. 25, 2004 (IT) ..... MI2004A1289

(51) Int. Cl.
*B01J 29/06* (2006.01)
*C07C 6/12* (2006.01)
*C07C 2/66* (2006.01)

(52) U.S. Cl. ..... 502/60; 502/63; 502/64; 502/68; 423/700; 423/704; 585/446; 585/450; 585/467; 585/470; 585/475

(58) Field of Classification Search ..... 502/60, 502/63, 64, 68; 423/700, 704; 585/446, 585/450, 467, 470, 475
See application file for complete search history.

(56) References Cited

U.S. PATENT DOCUMENTS

| | | | | |
|---|---|---|---|---|
| 4,384,161 | A | 5/1983 | Huang | |
| 4,891,458 | A | 1/1990 | Innes et al. | |
| 5,959,168 | A | 9/1999 | van der Aalst et al. | |
| 7,459,412 | B2 * | 12/2008 | Lercher et al. | 502/60 |
| 2004/0045871 | A1 | 3/2004 | Bauer | |
| 2007/0209968 | A1 * | 9/2007 | Euzen | 208/108 |

FOREIGN PATENT DOCUMENTS

| | | |
|---|---|---|
| WO | 91 11413 | 8/1991 |
| WO | 93 20029 | 10/1993 |

OTHER PUBLICATIONS

Corma et al., "Isbutane/2-butene alkylation on zeolite beta: Influence of post-synthesis treatments", Applied Catalysis A: General, 142 (1996), 139-150.*

Mintova et al., "Variation of the Si/Al ratio in nanosized zeolite Beta crystals", Microporous and Mesoporous Materials, 90 (2006), 237-245.*

* cited by examiner

*Primary Examiner* — Elizabeth Wood
(74) *Attorney, Agent, or Firm* — Oblon, Spivak, McClelland, Maier & Neustadt, L.L.P.

(57) ABSTRACT

The present invention relates to a new zeolite having a beta-type crystalline structure, characterized by a distribution of the Lewis acid sites and Brønsted acid sites corresponding to a molar ratio [Lewis sites] [Brønsted sites] equal to or higher than 1.5. This new zeolite is useful in preparation processes of alkylated aromatic hydrocarbons through the alkylation and/or transalkylation of aromatic compounds. The preparation method of the new zeolite is also object of the present invention.

56 Claims, No Drawings

CATALYST AND PROCESS FOR THE PREPARATION OF ALKYLATED AROMATIC HYDROCARBONS

The present invention relates to a new zeolite having a beta-type crystalline structure, characterized by a particular distribution of the typology of the acid sites. This new zeolite is useful in preparation processes of alkylated aromatic hydrocarbons through the alkylation and/or transalkylation of aromatic compounds. In particular, it is useful in the alkylation of benzene with propylene or ethylene and in the transalkylation of benzene with polyisopropylbenzenes or polyethylbenzenes to give cumene and ethyl benzene, respectively. The preparation method of the new zeolite is also object of the present invention.

The use of beta zeolite as an alkylation and transalkylation catalyst of aromatic substrates, has been known for some time. Optimal results in terms of industrial application have been obtained, for example, in the synthesis of cumene and ethyl benzene, using zeolites having beta-type structures, as described in EP 432,814, and in particular using catalysts containing beta zeolites according to what is described in EP 687,500 and in EP 847,802.

Industrial processes for the production of cumene and ethyl benzene based on zeolite catalysts are normally characterized by the presence of an alkylation section—in which the mono-alkylated product is obtained together with a certain fraction of polyalkylated by-products and impurities—as well as by the presence of a transalkylation section wherein the poly-alkylated by-products are recovered to re-produce the mono-alkylated product and impurities.

The selectivity to mono-alkylated product in the alkylation section—which must be as high as possible in order to have a low fraction of polyalkylated products to be recovered in the subsequent transalkylation section—has a key role in these processes, together with a low production of impurities, in particular those impurities whose boiling point is very close to that of the mono-alkylated product, such as n-propyl benzene, in the case of the production of cumene, or xylenes in the case of the production of ethyl benzene.

Reduction in the formation of other impurities such as oligomers, butyl benzenes, pentyl benzenes in the case of cumene or diphenyl ethanes in the case of ethyl benzene, also has an important role in the industrial production of cumene and ethyl benzene.

A new zeolite material has been found, having a beta-type crystalline structure and particular acidity characteristics, capable of achieving a higher selectivity to mono-alkylated product as well as a lower formation of impurities.

Beta zeolite was described for the first time in U.S. Pat. No. 3,308,069 and has the following general chemical composition:

$$(x/n)\mathrm{M}.(1.0-x)\mathrm{TEA}.\mathrm{AlO_2}.y\mathrm{SiO_2}.w\mathrm{H_2O} \quad \text{(I)}$$

wherein y ranges from 5 to 100, w is lower than or equal to 4, M is a metal ion, such as, for example, sodium, n is the valence of the metal ion M, x may have a value ranging from 0 to 1, TEA is a tetraethyl ammonium ion.

It is known that the metal ion can be removed from the zeolite through ion exchange, for example with ammonium nitrate. The zeolite, in its so-called acid form, is obtained following subsequent calcination.

The presence of different kinds of acid sites in beta zeolites, classified as Brønsted sites (protic sites) and of acid sites which can be classified as Lewis sites (non-protic sites) is described, for example, in Zeolites, 1990, 10, 304, V. L. Zholobenko et al. and in J. Catal., 1998, 180, 234, P. J. Kunkeler et al.

The qualitative and quantitative determination of the Brønsted and Lewis acid sites can be carried out through infrared spectroscopy, with the help of probe-molecules, among which pyridine is the most widely used, as described, for example, by C. A. Emeis in Journal of Catalysis, 1993, 141, 347.

It is known that the quantity and nature (Brønsted or Lewis) of the acid sites in zeolites in general and, in particular, in beta zeolite, can be varied through post-synthesis operations effected on the zeolite material, consisting of ion exchange treatment, vapour treatment, treatment with acids or thermal treatment.

These treatments are generally directed at dismantling the structure of the aluminum present in the crystalline lattice of the zeolite and re-allocating it in extra-lattice positions or removing said aluminum from the zeolite in order to obtain, for example, zeolites with a high Si/Al ratio.

De-aluminumating treatment does in fact represent one of the main and most widely-used types of post-synthesis treatment in zeolites, in order to enhance the catalytic performances.

In Zeolites 1990, 10, 304, V, L. Zholobenko et al. describe post-synthesis de-aluminumating treatment using vapour, as a result of which, the catalytic activity of an HZSM-5 zeolite in the cracking of n-hexane, proves to be considerably improved. This improvement in the performances of HZSM-5 zeolite may derive from the presence of Lewis acid sites, presumably due to the extra-structural aluminum produced by the effect of the de-aluminumating treatment with vapour. In other cases, the presence of Lewis acid sites generated by post-synthesis treatments, such as those described above, can, on the other hand, prove to be negative, depending on the specific chemical reaction in which the catalyst is used.

In the case of beta zeolite, for example, the presence of Lewis sites is negative in the catalytic performances in the isomerization reaction of n-butane, as described in Appl. Catal. A, 1999, 185, 123, Baburek J. et al.

De-aluminumating post-synthesis treatment effected on the beta zeolite is described, for example, in U.S. Pat. No. 5,310,534, wherein the beta zeolite used is in a non-calcined form and still contains the organic compounds deriving from the synthesis, and also in EP 0690024 wherein the beta zeolite is, on the contrary, in the calcined form, i.e. in the form deprived of the organic compounds coming from the synthesis.

J. Catal., 1998, 180, 234 P. J. Kunkeler et al., for example, describes a post-synthesis treatment through calcination under controlled conditions, effected on beta zeolite, as a result of which Lewis acid sites should be formed, capable of enhancing the catalytic properties of the beta zeolite in the specific Meerwein-Ponndorf-Verley reaction for the reduction of ketones.

A beta zeolite is described in U.S. Pat. No. 5,116,794, prepared by means of a series of conventional ion-exchange, calcination and activation treatment at a temperature ranging from 625 to 675° C., following which, an increase in the activity in the cracking reaction of n-butane is obtained.

The Applicant has now found that, in the absence of any post-synthesis treatment, it is possible to synthesize beta zeolites characterized by particular distributions of the acid site typology on the surface, which allow enhanced catalytic performances to be obtained in the preparation processes of alkylated aromatic compounds through the alkylation and/or transalkylation of aromatic compounds.

A first object of the present invention therefore relates to a beta zeolite characterized by a distribution of the Lewis acid sites (non-protic acid sites) and of the Brønsted acid sites (protic acid sites) corresponding to a molar ratio [Lewis sites]/[Brønsted sites] equal to or higher than 1.5.

The molar ratio $SiO_2/Al_2O_3$ in the crystalline lattice of the zeolites of the present invention can vary within the range of 10 to 30, preferably from 10 to 25.

The content of $Na^+$ ions is preferably lower than 200 ppm by weight with respect to the weight of zeolite in its acid form obtained after calcination.

The qualitative and quantitative determination of the Brønsted and Lewis acid sites was effected in the materials, object of the present invention, through infrared spectroscopy with the help of pyridine as probe-molecule, as described by C. A. Emeis in Journal of Catalysis 1993, 141, 347.

The particular distribution characteristics of the Lewis and Brønsted acid sites of the material of the present invention, create the best performances of the material in the alkylation and transalkylation reactions of aromatic compounds. In particular, this material, used in preparation reactions of alkylated aromatic hydrocarbons, allows a higher selectivity to be obtained to mono-alkylated product, a reduced production of non-recoverable polyalkylated by-products, a reduced production of critical by-products, as well as a reduced deactivation rate of the catalyst due to the formation of coke.

In the particular case of the industrial synthesis of cumene starting from benzene and propylene, the new zeolite material, object of the present invention, is capable of causing a lower formation of propylene oligomers to which the role of precursors is generally attributed in the formation of heavy organic products, called coke, which, in turn, are responsible for the deactivation of the solid acid catalysts and in particular of zeolite catalysts. This peculiarity of the zeolite material, object of the present invention, is fundamental in obtaining another extremely important result in the industrial synthesis of cumene, i.e. a reduction in the formation of the n-propyl benzene impurity. The formation of n-propyl benzene in the synthesis of cumene starting from benzene and propylene, is in fact normally favoured by an increase in the reaction temperature, whereas the formation of propylene oligomers, on the contrary, is favoured by a decrease in temperature. With the use of the zeolite material of the present invention, it is possible to carry out the reaction at lower temperatures without jeopardizing the duration of the catalyst, due to the reduced formation of propylene oligomers, with the advantage of a consequent lower formation of n-propyl benzene.

The zeolite material of the present invention is prepared by means of a suitable process which determines the production of the particular molar ratio between the Lewis and Brønsted acid sites.

A further object of the invention therefore relates to a process for the preparation of beta zeolite characterized by a molar ratio between the quantity of Lewis-type and Brønsted-type acid sites equal to or higher than 1.5.

U.S. Pat. No. 3,308,069 describes a preparation procedure of beta zeolite substantially consisting of a hydrothermal synthesis in an aqueous environment, starting from a reaction mixture containing silicon and aluminum sources together with the templating agent tetraethyl ammonium hydroxide (TEAOH) in the following molar ratios:

$[SiO_2]/[Al_2O_3]$ ranging from 10 to 200

$[TEAOH]/[SiO_2]$ ranging from 0.1 to 1.0

$[H_2O]/[TEAOH]$ ranging from 20 to 75

$[Na_2O]/[TEAOH]$ ranging from 0.0 to 0.1.

Said reagent mixture is maintained at a temperature ranging from 75 to 200° C., until the crystalline product of formula (I) is obtained.

It has now been surprisingly found that it is possible to pre-determine the acidity characteristics of the material and in particular the molar ratio between the Lewis and the Brønsted acid sites, i.e. the [Lewis sites]/[Brønsted sites] ratio, by suitably selecting the composition of the reagent mixture to be subjected to hydrothermal crystallization.

According to the present invention, the beta zeolites are synthesized in an aqueous environment starting from reagent mixtures consisting of sodium aluminate and aluminum alkoxides or, as an alternative to aluminum alkoxides, aluminum inorganic salts, as aluminum source, and a silica source selected from colloidal silica, tetra-alkyl silicates and amorphous silica, and with tetra-ethyl ammonium hydroxide as templating agent.

The reagent mixtures containing the above compounds are characterized by the following molar ratios:

$[SiO_2]/[Al_2O_3]$=10-30, preferably 10-25

$[TEAOH]/[SiO_2]$=0.10-0.35, preferably 0.15-0.30

$[H_2O]/[SiO_2]$=7-20, preferably 8-15

$[Na_2O]/[TEAOH]$ higher than 0.1.

For the purposes of the present invention, in addition to the parameters described above, the strict control of the [Na]/[Al] molar ratio, in the synthesis mixture, which must be higher than 0.68 and lower than 1, is necessary. This parameter, as shown in the examples provided hereafter, is particularly critical for the success of the synthesis of beta zeolite, object of the present invention. For [Na]/[Al] molar ratios lower than or equal to 0.68, in fact, beta zeolite is not obtained, but rather an amorphous, instead of crystalline, end-product, whereas for [Na]/[Al] molar ratios higher than or equal to 1.00, a well-crystallized beta zeolite is obtained, but characterized however by molar ratio values between the Lewis and Brønsted acid sites always lower than 1.5.

The tetra alkyl-silicate can be selected from tetramethyl-, tetraethyl-, or tetrapropyl-silicate.

The aluminum alkoxide is preferably aluminum isopropylate or ter-butylate.

The aluminum salt can be aluminum nitrate or sulphate.

The crystallization of the zeolite from the reagent mixture is carried out under hydrothermal conditions at temperatures ranging from 150 to 190° C., preferably from 165 to 180° C., for a period of time ranging from 10 to 240 hours, preferably from 18 to 150 hours.

The suspension or slurry thus obtained is filtered. The suspension obtained at the end of the crystallization can be optionally acidified before filtering, for example with acetic acid, hydrochloric acid, nitric acid, formic acid, propionic acid or oxalic acid, until a pH ranging from 3 to 6 is reached, and subsequently diluted with water in a ratio (water added volume)/(slurry volume) ranging from 1 to 10.

The solid product resulting from the filtration is dispersed again in water and is subjected to an ion exchange treatment, according to the known technique of the art, with an ammonium salt, for example ammonium acetate, to obtain the zeolite in ammonium/alkylammonium form. At the end of the operation, the solid thus obtained is filtered, dried at a temperature ranging from 100 to 200° C., for a period of time ranging from 8 to 16 hours and is then calcined in air at a temperature ranging from 450 to 650° C. for a period of 4 to 8 hours. The beta zeolite thus obtained has an L/B [Lewis sites]/[Brønsted sites] molar ratio higher than or equal to 1.5.

The beta zeolites obtained according to the procedure of the present invention, also prove to consist of submicronic agglomerates of crystallites whose dimensions are generally lower than 300 Å, preferably having at least 90% of crystallites with dimensions lower than 300 Å. This peculiarity favours the catalytic activity of the beta zeolite in the chemical reactions object of the present invention.

Catalysts containing beta zeolite, object of the present invention, suitable for being used in fixed bed catalyst reactors, are prepared starting from the active phase of beta zeolite and an inorganic binder.

The inorganic binder is selected from aluminum, silicon or magnesium oxides, natural clays or combinations thereof, in weight proportions, with respect to the zeolite, varying from 80:20 to 5:95, preferably from 70:30 to 10:90. Said mixture can also contain peptizing agents and plasticizers. The forming conditions and procedures are all known to experts in the field, the catalyst can be prepared in pellets, in tablets, cylinders or any other form suitable for the purpose. The forming procedures of the beta zeolite-based catalyst described in EP 847,802, wherein a beta-type zeolite in ammonium/alkylammonium form is bound by an inorganic binder, according to a particular procedure, are particularly preferred: in this case, the resulting catalyst, suitable for use in fixed bed reactors, contains the beta zeolite of the present invention and is characterized by an extra-zeolite porosity—i.e. the porosity obtained by adding the mesoporosity to the macroporosity of the catalytic composition, therefore excluding the contribution of the microporosity due to the zeolite having a total volume at least equal to 0.80 ml/g and consisting, for a fraction of at least 25%, of pores with a radius larger than 100 Å.

The specific aspect of the zeolite material, object of the present invention, consists of the unexpected behaviour observed in terms of selectivity in the alkylation and transalkylation reactions of aromatic compounds, in particular in alkylation reactions of benzene with propylene and ethylene, as well as in transalkylation reactions of benzene with polyisopropyl benzenes and polyethyl benzenes, to give cumene and ethyl benzene, respectively: the beta zeolite, object of the present invention, and the catalysts deriving therefrom, prove to be more selective towards mono-alkylation, regardless of the total content of aluminum, with a reduced formation of unrecoverable polyalkylated by-products and other critical by-products, and a reduced de-activation rate of the catalyst.

A further object of the present invention therefore relates to an alkylation process of aromatic hydrocarbons, preferably benzene, with ethylene or propylene, carried out in the presence of a catalyst containing a beta zeolite characterized by a molar ratio between the amount of Lewis acid cites (L) and the amount of Brønsted acid sites (B) equal to or higher than 1.5.

The alkylation process of aromatic compounds, in particular the alkylation reaction of benzene with propylene or ethylene to give cumene or ethyl benzene, respectively, is carried out according to what is known in the state of the art, at reactor temperatures normally ranging from 100 to 300° C. and reaction pressures normally ranging from 1 to 100 bar. In the case of the alkylation of benzene with propylene to cumene, the temperature preferably ranges from 150 to 200° C., more preferably from 120 to 180° C.

In the case of the alkylation of benzene with ethylene to ethyl benzene, the reactor temperature preferably ranges from 150 to 250° C., more preferably from 170 to 230° C.

The reaction pressure, both in the case of benzene alkylation with propylene and also that with ethylene, is preferably selected so that the reaction is effected under conditions of at least partially liquid phase and it therefore preferably ranges from 10 to 50 bar.

The molar ratio between the aromatic compound and the olefin fed to the reaction, normally ranges from 1 to 30, preferably from 2 to 15.

The process can be carried out batchwise, in semi-continuous or in continuous, and in several types of reactors, according to what is normally known in the state of the art, but is preferably carried out in continuous in one or more fixed bed catalyst reactors, in series. In this case the space velocity (WHSV, in terms of kg of reagent mixture fed per kg of catalyst, per hour, referring to the zeolite weight only, contained in the catalyst) normally ranges from 0.1 to 20 $hrs^{-1}$, preferably from 0.5 to 10 $hrs^{-1}$. When the process is carried out in continuous, it is also possible to use a configuration of the reaction system which includes the partial recycling of the effluent to the reactor itself, possibly after cooling.

In order to overcome the exothermic nature of the reaction and guarantee that the temperature be maintained within the selected range, the catalyst can be distributed in various layers or in several reactors in series, and a cooling can be effected between the catalyst layers or between one reactor and another. The reagents can be fed to the first of the catalytic beds or reactors in series, or the feeding of one or both reagents can be partialized between the single beds or single reactors.

This operational procedure can allow a more efficient limitation of the maximum reaction temperature, as well as obtaining a higher ratio between the aromatic compound and the alkylating agent, with the same overall ratio fed, with an obvious advantage towards the selectivity to mono-alkylated product, as known to experts in the field.

A further object of the present invention relates to a process for the transalkylation of aromatic hydrocarbons with one or more polyalkylated aromatic hydrocarbons, carried out in the presence of a catalyst containing a beta zeolite characterized by a molar ratio between the quantity of Lewis acid sites (L) and the quantity of Brønsted acid sites (B) equal to or higher than 1.5. The aromatic hydrocarbon is preferably benzene. The polyalkylated aromatic hydrocarbons are preferably mixtures of aromatic hydrocarbons, prevalently di-alkylated hydrocarbons. Even more preferably the polyalkylated aromatic hydrocarbon is selected from diethyl benzene, possibly in a mix with triethyl benzene, and diisopropyl benzene, possibly in a mix with triisopropyl benzene. The transalkylation of benzene with diethyl benzene, and possibly triethyl benzene, and the transalkylation of benzene with diisopropyl benzene, and possibly triisopropyl benzene, are particularly preferred.

This reaction is carried out at a temperature ranging from 100 to 350° C. In the case of the transalkylation of benzene to cumene with polyisopropylbenzenes, the temperature preferably ranges from 150 to 250° C. In the case of the transalkylation of benzene to ethyl benzene with polyethylbenzenes, the temperature preferably ranges from 180 to 300° C. The reaction pressure is preferably selected so that the reaction is effected under conditions of at least partially liquid phase, more preferably under liquid phase conditions and therefore preferably ranges from 20 to 50 bar. The process is preferably carried out in continuous, in a fixed bed reactor. In this case, the space velocity (WHSV, in terms of kg of reagent mixture fed per kg of catalyst, per hour, referring to the zeolite weight only, contained in the catalyst) normally ranges from 0.5 to 10 $hrs^{-1}$. The molar ratio between the aromatic hydrocarbon and the sum of the polyalkylated aromatic hydrocarbons in the feeding mixture to the transalkylation reaction, can vary from 1 to 40, preferably from 3 to 30.

A further aspect of the present invention is an enhanced process for preparing mono-alkylated aromatic hydrocarbons, comprising:

a) putting an aromatic hydrocarbon in contact with an olefin, under alkylation conditions, in the presence of the catalyst object of the invention;

b) separating the product obtained into a fraction containing the aromatic hydrocarbon, a fraction containing the mono-alkylated aromatic hydrocarbon, a fraction containing poly-alkylated aromatic hydrocarbons, preferably containing mainly dialkylated aromatic hydrocarbons, and a fraction of heavy aromatic hydrocarbons;

c) putting the fraction containing poly-alkylated aromatic hydrocarbons, preferably prevalently containing di-alkylated aromatic hydrocarbons, in contact with the aromatic hydrocarbon, in the presence of the catalyst object of the present invention, under transalkylation conditions;

d) separating the product obtained from step c) into the same fractions already obtained in step b), then recycling the fraction containing the aromatic hydrocarbon partially to step a) and partially to step c), and the fraction containing the polyalkylated aromatic hydrocarbons to step c).

The fraction containing the mono-alkylated aromatic hydrocarbon coming from step b), where the effluents of steps c) and a) are sent, represents the desired product.

The olefin used in the alkylation step is preferably selected from ethylene and propylene. The aromatic hydrocarbon used in the alkylation and transalkylation step is preferably benzene. When the alkylation product is obtained from the alkylation reaction of benzene with propylene, the first fraction in step (b) mainly consists of benzene, the second fraction mainly of cumene and the third fraction mainly of diisopropyl benzenes. When the alkylation product is obtained from the alkylation reaction of benzene with ethylene, the first fraction in step (b) mainly consists of benzene, the second fraction mainly of ethyl benzene, the third fraction mainly of diethyl benzenes.

Some illustrative examples are provided for a better understanding of the present invention and for its embodiment but should in no way be considered as limiting the scope of the invention itself.

EXAMPLE NR. 1

157.1 g of tetraethyl ammonium hydroxide at 35% by weight, in aqueous solution, are added to 35.6 g of demineralized water. 14.0 g of sodium aluminate at 54% by weight of $Al_2O_3$ and 12.2 g of aluminum isopropylate are then added, at about 70° C., under constant stirring until a limpid solution is obtained. 280.4 g of Ludox HS 40 colloidal silica at 40% of $SiO_2$ are added to this solution. A homogeneous suspension is obtained, which is charged into an AISI 316 steel autoclave, equipped with an anchor stirrer. The mixture is left to crystallize under hydrothermal conditions at 170° C. for 24 hours.

At this point, the autoclave is cooled. The crystallization slurry is treated with 130 g of acetic acid in an aqueous solution at a 3N concentration, under stirring, obtaining a rather dense suspension to which 3 liters of demineralized water are added. The suspension thus obtained is filtered. The resulting zeolite is then re-dispersed in 3 liters of demineralized water, in which 50 g of ammonium acetate have been previously dissolved. After 3 hours the solid matter is filtered. A humid panel of beta zeolite is thus obtained in ammonium/alkylammonium form. The panel is dried at 150° C. and then calcined in air at 550° C. for 5 hours. The final product is analyzed by means of X-ray powder diffractometry, and from these results the product appears to consist of high purity Beta zeolite. The chemical analysis of the final product shows a molar ratio $[SiO_2]/[Al_2O_3]=17.2$.

The qualitative and quantitative determination of the Brønsted and Lewis acid sites is effected by infrared spectroscopy, with the help of pyridine as probe molecule, as described by C. A. Emeis in Journal of Catalysis, 1993, 141, 347. The procedure is as follows:

1. a sample of beta zeolite is compressed into a tablet suitable for the determination of the IR spectrum
2. the sample is placed under high vacuum ($10^{-5}$ torr) at 400° C. for 1 hour in a cell suitable for measuring the IR spectrum.
3. the sample thus treated is put in contact with pyridine, its vapours being introduced into the cell from a suitable liquid supply, at a pressure equal to the vapour pressure at room temperature for 15 min.
4. the excess pyridine is desorbed from the sample at 250° C. for 1 hour under vacuum
5. The IR spectrum is recorded, measuring the integrated intensity, called I, of the band at 1545 $cm^{-1}$, associated with the pyridinium ion formed by interaction with a Brønsted acid site, and of the band at 1455 $cm^{1}$ associated with the pyridine adsorbed on a Lewis acid site.

The concentration of the acid sites A (mmol/g of zeolite) is obtained through the equation $$A=I/(\epsilon \times S)$$

wherein S is called "thickness" of the tablet and is indicated as ($mg/cm^2$) and $\epsilon$ (cm/micromol.) is the molar extinction coefficient, for which the values 2.22 and 1.67 (cm/micromol.) are used, for the bands at 1545 $cm^{-1}$ and 1455 $cm^{1}$, respectively (according to what is described by C. A. Emeis in Journal of Catalysis, 1993, 141, 347).

The molar ratio, indicated by IR analysis effected on the zeolite, between the quantity of Lewis acid sites (L) and the quantity of Brønsted acid sites (B) is equal to 2.0.

The synthesis conditions and relevant results are shown in table 1.

EXAMPLE NR 2 (COMPARATIVE)

157.1 g of tetraethylammonium hydroxide at 35% by weight, in a water solution, are added to 299.5 g of demineralized water, 20.8 g of sodium aluminate at 54% by weight of $Al_2O_3$ are then added, maintaining the mixture under stirring, at about 70° C., until a limpid solution is obtained. 280.4 g of Ludox HS 40 colloidal silica at 40% of $SiO_2$ are added to the solution. A homogeneous suspension is obtained, which is charged into a steel AISI 316 autoclave equipped with an anchor stirrer. The gel is left to crystallize under hydrothermal conditions at 170° C. for 168 hours.

The autoclave is then cooled and the slurry treated as described in example 1.

The final product is subjected to X-ray diffractometry analysis of powders and the result obtained is that it consists of high purity Beta zeolite. Chemical analysis on the final product indicates a molar ratio $[SiO_2]/[Al_2O_2]=16.4$.

Upon IR analysis carried out as described in example 1, the zeolite shows a molar ratio between the quantity of Lewis acid sites (L) and the quantity of Brønsted acid sites (B) equal to 1.2.

The synthesis conditions and relevant results are shown in table 1.

EXAMPLE NR 3 (COMPARATIVE)

157.1 g of tetraethylammonium hydroxide at 35% by weight, in a water solution, are added to 36.3 g of demineralized alized water. 14.2 g of sodium aluminate at 54% by weight of $Al_2O_3$ are then added, maintaining the mixture under stirring, at about 70° C., until a limpid solution is obtained, 280.4 g of Ludox HS 40 colloidal silica at 40% of $SiO_2$ are added to the solution. A homogeneous suspension is obtained, which is charged into a steel AISI 316 autoclave equipped with an anchor stirrer. The gel is left to crystallize under hydrothermal conditions at 170° C. for 24 hours.

The autoclave is then cooled and the slurry treated as described in example 1.

The final product is subjected to X-ray diffractometry analysis of powders and the result obtained is that it consists of high purity Beta zeolite. Chemical analysis on the final product shows a molar ratio $[SiO_2]/[Al_2O_3]=26$.

Upon IR analysis carried out as described in example 1, the zeolite shows a molar ratio (L/B) between the quantity of Lewis acid sites (L) and the quantity of Brønsted acid sites (B) equal to 0.97. The synthesis conditions and relevant results are shown in table 1.

EXAMPLE NR 4 (COMPARATIVE)

157.1 g of tetraethylammonium hydroxide at 35% by weight, in a water solution, are added to 35.9 g of demineralized water. 14.2 g of sodium aluminate at 54% by weight of $Al_2O_3$ and 14.3 g of aluminum iso-propoxide are then added, maintaining the mixture under stirring, at about 70° C., until a limpid solution is obtained. 280.4 g of Ludox HS 40 colloidal silica at 40% of $SiO_2$ are added to the solution. A homogeneous suspension is obtained, which is charged into a steel AISI 316 autoclave equipped with an anchor stirrer. The gel is left to crystallize under hydrothermal conditions at 170° C. for 168 hours The autoclave is then cooled and the slurry treated as described in example 1.

X-ray diffractometry analysis shows that the product thus obtained is amorphous.

The synthesis conditions and relevant results are shown in table 1.

In this table, the first column indicates the reference example number, the second, third, fourth and fifth columns indicate the molar ratios between the different reagents, for each example. The sixth column indicates the duration of the hydrothermal synthesis. The seventh column indicates the nature of the phase, crystalline or amorphous, obtained on the basis of XRD analysis. The eighth column indicates the result of the chemical analysis as a silica/alumina SAR (Silica to Alumina Ratio) molar ratio and the last column indicates the result obtained by titration with pyridine of the acid sites (as described above), expressed as a molar ratio between the Lewis acid sites and the Brønsted acid sites.

TABLE 1

| Ex. | $SiO_2/Al_2O_3$ | TEA/$SiO_2$ | Na/Al | $H_2O/SiO_2$ | $t_{cryst}$ (hrs) | XRD | SAR | L/B |
|---|---|---|---|---|---|---|---|---|
| 1 | 18 | 0.2 | 0.71 | 9.1 | 24 | Beta | 17.2 | 2.0 |
| 2 | 17 | 0.2 | 1.00 | 17 | 168 | Beta | 16.41 | 1.2 |
| 3 | 25 | 0.2 | 1.00 | 9.1 | 24 | Beta | 26 | 0.97 |
| 4 | 17 | 0.2 | 0.68 | 9.1 | 168 | amorph. | — | — |

It can be observed that a [L]/[B] ratio higher than 1.5, as in example 1, can only be obtained by operating at [Na]/[Al] molar ratios higher than 0.68 and lower than 1.

When operating, on the contrary, even only at the upper limit of the range claimed for the [Na]/[Al] parameter, a [L]/[B] ratio is obtained which is lower than 1.5, as in examples 2 and 3. When operating below the lower limit of the range claimed for the [Na]/[Al] parameter, an amorphous material is obtained as in example 4.

EXAMPLE NR. 5

0.4 g of beta zeolite prepared according to what is described in example 1, previously dried to 120° C. for 16 hours, are charged into an electrically heated autoclave with an internal volume equal to 0.5 liters, equipped with a mechanical stirrer and with all the necessary devices for the feeding of the benzene and propylene reagents.

The autoclave is closed, put under vacuum by suction with a pump connected externally, and 352 g of benzene are then charged by suction. The autoclave is pressurized with nitrogen until a pressure of about 6 bar is reached and the heating is initiated to the programmed temperature of 150° C. When the temperature inside the autoclave has stably reached the pre-selected value, 26 g of propylene are rapidly fed, by means of a pressure tank, and the mixture is left to react for a time of exactly 1 hour, calculated starting from the end of the propylene feeding.

At the end of the reaction, the product is discharged and analyzed by gas chromatography. The following products are present in the mixture at the end of the reaction: benzene, cumene, $C_6$ and $C_9$ oligomers of propylene, diisopropyl benzenes, other diisopropyl benzene isomers ($C_6$-phenyl=aromatic products generally indicated with the formula $C_{12}H_{18}$), triisopropyl benzenes, other triisopropyl benzene isomers ($C_9$-phenyl=aromatic products generally indicated with the formula $C_{15}H_{24}$), polyalkylated products with a molecular weight higher than triisopropyl benzene (heavy polyalkylated products).

The propylene conversion proves to be higher than 97.0%, the selectivity to mono-alkylated product (cumene) with respect to the converted propylene is equal to 91.3% and the selectivity to (cumene+diisopropyl benzenes+triisopropyl benzenes) with respect to the converted propylene is equal to 97.5%.

The weight ratio, called R, between the sum of (diisopropyl benzenes+triisopropyl benzenes+$C_6$-phenyl+$C_9$-phenyl+heavy polyalkylated products) and the sum of (cumene+diisopropyl benzenes+triisopropyl benzenes+$C_6$-phenyl+$C_9$-phenyl+heavy polyalkylated products) proves to be equal to 0.052.

This ratio R is a measurement of the total quantity of the polyalkylated by-products alone with respect to the total products and alkylated by-products formed during the reaction.

EXAMPLE NR 6 (COMPARATIVE)

The catalytic test described in example 5 is repeated using the beta zeolite prepared according to example 2.

On the basis of the gas-chromatographic analysis of the reaction product, a propylene conversion is calculated which is higher than 97.0%, together with a selectivity to mono-alkylated product (cumene) with respect to the converted propylene, equal to 90.9% and a selectivity to (cumene+diisopropyl benzenes+triisopropyl benzenes) with respect to the converted propylene equal to 96.6%. The ratio R, defined as in example 1, proves to be equal to 0.061.

It is evident that by using the non-representative catalyst of the present invention, a higher fraction of polyalkylated by-products is obtained with respect to that obtained, on the contrary, using a catalyst according to the present invention.

EXAMPLE NR 7 (COMPARATIVE)

The catalytic test described in example 5 is repeated using the beta zeolite prepared according to what is described in example 3.

On the basis of the gas-chromatographic analysis of the reaction product, a propylene conversion is calculated which is higher than 98.1%, together with a selectivity to mono-alkylated product (cumene) with respect to the converted propylene, equal to 89.8% and a selectivity to (cumene+diisopropyl benzenes+triisopropyl benzenes) with respect to the converted propylene equal to 95.0%. The ratio R, defined as in example 1, proves to be equal to 0.064.

It is evident that by using the non-representative catalyst of the present invention, a higher fraction of polyalkylated by-products is obtained with respect to that obtained, on the contrary, using a catalyst according to the present invention.

EXAMPLE NR 8

The beta zeolite of example 1 in ammonium/alkylammonium form, i.e. in the form which has not undergone the final calcination step, is used for the preparation of a catalyst in pellet form adopting the procedure described in example 4 of EP 847,802. Alumina in the form of p-bohemite, is used as binder. The catalyst thus formed is calcined for 5 hours at 550° C. The percentage of zeolite in the end-catalyst is equal to 55% by weight, and the catalyst has the following porosity characteristics:

EPV (extra-zeolite porous volume) equal to 0.85 cc/g, fraction of pores having a radius >100 Å equal to 51%.

The catalyst thus obtained, called catalyst A, is used for carrying out a continuous catalytic test for the alkylation of benzene with propylene using an experimental apparatus such as that described below.

The experimental apparatus consists of reagent tanks, independent feeding pumps, a static mixer of the reagents before being fed into the reaction, a steel reactor situated inside an electric heating oven equipped with temperature regulation inside the reactor, a regulation system of the pressure inside the reactor by means of a pneumatic valve, a cooler of the reaction effluent and a collection system of the liquid and gaseous products.

The reactor, situated inside the heating oven, consists of a cylindrical steel tube, with a mechanical sealing system and an internal diameter equal to about 2 cm.

A thermometric sheath having a diameter equal to 1 mm and containing a thermocouple which is free to slide along the greater axis of the reactor, is situated inside and along the greater axis of the reactor. Catalyst A, previously ground and sieved in order to obtain a particle size ranging from 1 to 1.25 mm, is charged into the reactor, in a quantity equal to 5 g, for a total height of the catalytic bed equal to 6 cm.

A quantity of inert quartz material is charged above and below the catalytic bed for a height equal to 3 cm above and 3 cm below the catalytic bed.

The electric heating of the reactor is activated, together with a nitrogen flow in order to dry the catalyst, up to the temperature of 150° C. programmed inside the reactor. Once the selected temperature has been reached, the nitrogen flow is maintained for 16 hours, after which it is interrupted and benzene is fed first for two hours followed by propylene so as to obtain an overall WHSV equal to 20 hours$^{-1}$ and a [benzene]/[propylene] molar ratio in the feeding equal to 7. The pressure at which the reaction is carried out is equal to 38 bar.

Samplings are taken of the reaction effluent after 21, 93, 118, 260 and 284 hours of reaction carried out in continuous under the same reaction conditions, which are subsequently subjected to gas-chromatographic analysis.

On the basis of the analysis effected on each sample of reaction effluent, the propylene conversion proved to be always higher than 99.0%. The following average performances of catalyst A were also obtained:

- selectivity to cumene with respect to the converted propylene equal to 90.2% with a standard deviation equal to 0.4%;
- selectivity to (cumene+diisopropyl benzenes+triisopropyl benzenes) with respect to the converted propylene equal to 99.7% with a standard deviation equal to 0.06%;
- concentration of n-propyl benzene with respect to the cumene equal to 238 ppm with a standard deviation equal to 14 ppm
- concentration of $C_6$- to $C_9$-oligomers of propylene with respect to the cumene equal to 204 ppm.

During the test, the position corresponding to the maximum temperature, determined by the exothermy of the reaction, was registered by means of the thermocouple sliding along the greater axis of the reactor. In this way, it is possible to measure the advancing rate of the so-called hot point which represents a direct measurement of the deactivation rate of the catalyst. By extrapolation of the measurement up to the end point of the catalytic bed, it was possible to estimate a cumene production upon reaching said end point of the catalytic bed, referring to the total quantity of catalyst charged equal to 2,800 kg cumene/kg of catalyst A.

EXAMPLE NR 9 (COMPARATIVE)

The beta zeolite of example 2 in ammonium/alkylammonium form is used for the preparation of a catalyst in pellet form adopting the procedure described in example 4 of EP 847,802. Alumina in the form of p-bohemite, is used. The catalyst thus formed is calcined for 5 hours at 550° C. The percentage of zeolite in the end-catalyst is equal to 55% by weight, and the catalyst has the following porosity characteristics:

EPV (extra-zeolite porous volume) equal to 0.82 cc/g, fraction of pores having a radius >100 Å equal to 52%.

The catalyst thus obtained, called catalyst B, is not representative of the present invention.

Catalyst B is used for carrying out a continuous catalytic test for the alkylation of benzene with propylene using an experimental apparatus such as that described in example 8 and with the same activation and operational procedure of the catalytic test itself.

Samplings are taken of the reaction effluent after 47, 124, 165, 190 and 286 hours of reaction carried out in continuous under the same reaction conditions, which are subsequently subjected to gas-chromatographic analysis. On the basis of the analysis effected on each sample of reaction effluent, the propylene conversion proved to be always higher than 99.0%. The following average performances of catalyst B were also obtained:

- selectivity to cumene with respect to the converted propylene equal to 87.5% with a standard deviation equal to 0.4%;
- selectivity to (cumene+diisopropyl benzenes+triisopropyl benzenes) with respect to the converted propylene equal to 99.7% with a standard deviation equal to 0.03%;
- concentration of n-propyl benzene with respect to the cumene equal to 253 ppm with a standard deviation equal to 8 ppm
- concentration of $C_6$- to $C_9$-oligomers of propylene with respect to the cumene equal to 264 ppm.

Also in this case, during the test, the position corresponding to the maximum temperature was registered by means of the thermocouple sliding along the greater axis of the reactor, for measuring the advancing rate of the so-called hot point, which represents a direct measurement of the deactivation rate of the catalyst. By extrapolation of the measurement up to the end point of the catalytic bed, it was possible to estimate a cumene production referring to the total quantity of catalyst charged equal to 2,150 kg cumene/kg of catalyst B.

Catalyst B, which is non-representative of the present invention, has a selectivity to cumene with respect to the converted propylene, i.e. selectivity to mono-alkylated product, which is much lower than that obtained with catalyst A in accordance with the present invention. This is even more evident from the result relating to the selectivity to (cumene+diisopropyl benzene+triisopropyl benzenes) with respect to the converted propylene for catalyst B which, on the other hand, is substantially analogous to that already obtained for catalyst A. In other words, when using catalyst A according to the present invention, a distribution of mono- and di-alkylated products is obtained which is more directed towards the mono-alkylated product than what is obtained with catalyst B, which is non-representative of the present invention, with the same selectivity towards the overall formation of mono- and dialkylated products.

Furthermore, catalyst B, most probably as a result of the greater formation of $C_6$-$C_9$ oligomeric products of propylene with respect to catalyst A, is characterized by a greater deactivation rate than that registered for catalyst A.

EXAMPLE NR 10

The same catalyst A already used in example 8 is subjected to a catalytic test under the same conditions described in example 8 except for the temperature of the reactor which is set at 140° C.

Samplings of the reaction effluent are taken after 46, 119, 137, 142 and 160 hours of reaction carried out in continuous under the same reaction conditions, which are subsequently subjected to gas-chromatographic analysis.

On the basis of the gas-chromatographic analysis, the propylene conversion proved to be always higher than 99.0%. The following average performances of catalyst A were also obtained:

- selectivity to cumene with respect to the converted propylene equal to 89.9% with a standard deviation equal to 0.8%;
- selectivity to (cumene+diisopropyl benzenes) with respect to the converted propylene equal to 99.5% with a standard deviation equal to 0.08%;
- concentration of n-propyl benzene with respect to the cumene equal to 187 ppm with a standard deviation equal to 7 ppm
- concentration of $C_6$- to $C_9$-oligomers of propylene with respect to the cumene equal to 279 ppm.

Also in this case, during the test, the position corresponding to the maximum temperature was registered by means of the thermocouple sliding along the greater axis of the reactor, for measuring the advancing rate of the so-called hot point, which represents a direct measurement of the deactivation rate of the catalyst. By extrapolation of the measurement up to the end point of the catalytic bed, it was possible to estimate a cumene production referring to the total quantity of catalyst charged equal to 1,730 kg cumene/kg of catalyst A.

The formation of n-propyl benzene and propylene oligomers impurities therefore follows the expected trend: the former decreases with a decrease in the temperature, whereas the latter increases with a decrease in the temperature with respect to what was already obtained with catalyst A, wherein the reaction is carried out at a higher temperature as in the previous example 8.

Lower reaction temperatures can consequently be selected for the production of cumene having a particular and high degree of purity.

EXAMPLE NR 11 (COMPARATIVE)

The same catalyst B already used in example 9 is subjected to a catalytic test under the same conditions described in example 10, with a reaction temperature which is set at 140° C.

Samplings of the reaction effluent are taken after 28, 94, 100, 118 and 122 hours of reaction carried out in continuous under the same reaction conditions, which are subsequently subjected to gas-chromatographic analysis.

On the basis of the gas-chromatographic analysis, the propylene conversion proved to be always higher than 99.0%.

The following average performances of catalyst B were also obtained:

- selectivity to cumene with respect to the converted propylene equal to 87.3% with a standard deviation equal to 0.4%;
- selectivity to (cumene diisopropyl benzenes) with respect to the converted propylene equal to 99.2% with a standard deviation equal to 0.2%;
- concentration of n-propyl benzene with respect to the cumene equal to 188 ppm with a standard deviation equal to 2 ppm
- concentration of $C_6$- to $C_9$-oligomers of propylene with respect to the cumene equal to 443 ppm.

Also in this case, during the test, the position corresponding to the maximum temperature was registered by means of the thermocouple sliding along the greater axis the reactor, for measuring the advancing rate of the so-called hot point, which represents a direct measurement of the deactivation rate of the catalyst. By extrapolation of the measurement up to the end point of the catalytic bed, it was possible to estimate a cumene production referring to the total quantity of catalyst charged equal to 1,020 kg cumene/kg of catalyst B.

It is evident that also using catalyst B at a temperature of 140° C., there is an effective reduction in the formation of n-propyl benzene with respect to what is obtained with the same catalyst B when carrying out the reaction at a temperature of 150° C. This reduction, however, is associated with a considerable increase in the formation of oligomers of propylene and a consequent significant reduction in the duration of the catalyst, which is much more distinct than that obtained with catalyst A at the same temperature.

Catalyst A, representative of the present invention, therefore allows the reaction to be carried out at more favourable temperatures to obtain a reduction in the formation of n-propyl benzene impurities which cannot be obtained, on the contrary, with catalyst B, non-representative of the present invention.

The invention claimed is:

1. An acidic beta zeolite obtained in the absence of any post-synthesis treatment, wherein a $SiO_2/Al_2O_3$ molar ratio in the crystalline lattice of the acidic beta zeolite varies within the range of from 10 to 25, and wherein the acidic beta zeolite has a [Lewis acid sites]/[Brønsted acid sites] molar ratio of greater than or equal to 1.5 as determined by infrared spectroscopy with pyridine as a probe molecule.

2. The acidic beta zeolite according to claim 1, wherein the $SiO_2/Al_2O_3$ molar ratio in the crystalline lattice of the acidic beta zeolite varies within the range of from 10 to 17.2.

3. The acidic beta zeolite according to claim 1, wherein the acidic beta zeolite has a [Lewis acid sites]/[Brønsted acid sites] molar ratio of greater than or equal to 1.5 as determined by infrared spectroscopy with pyridine as a probe molecule, wherein the infrared spectrum is measured after desorption of excess pyridine at 250° C. for 1 hour under vacuum.

4. The acidic beta zeolite according to claim 1, wherein the $SiO_2/Al_2O_3$ molar ratio in the crystalline lattice of the acidic beta zeolite varies within the range of from 10 to 17.2, and wherein the acidic beta zeolite has a [Lewis acid sites]/[Brønsted acid sites] molar ratio of greater than or equal to 1.5 as determined by infrared spectroscopy with pyridine as a probe molecule, wherein the infrared spectrum is measured after desorption of excess pyridine at 250° C. for 1 hour under vacuum.

5. The acidic beta zeolite according to claim 1, which is in the form of submicronic agglomerates of crystallites, wherein at least 90% of the crystallites have a dimension that is lower than 300 Å.

6. A catalytic composition comprising:
the acidic beta zeolite according to claim 1; and
an inorganic binder.

7. The catalytic composition according to claim 6, wherein the inorganic binder is selected from the group consisting of aluminum oxide, silicon oxide, magnesium oxide, natural clay, and combinations thereof.

8. The catalytic composition according to claim 6, wherein a weight ratio of the inorganic binder to the acidic beta zeolite varies from 80:20 to 5:95.

9. The catalytic composition according to claim 6, which is characterized by an extra-zeolite porosity having a total volume greater than or equal to 0.80 ml/g and consisting for a fraction of at least 25% of pores having a radius greater than 100 Å.

10. The acidic beta zeolite according to claim 2, which is in the form of submicronic agglomerates of crystallites, wherein at least 90% of the crystallites have a dimension that is lower than 300 Å.

11. A catalytic composition comprising:
the acidic beta zeolite according to claim 2; and
an inorganic binder.

12. The catalytic composition according to claim 11, wherein the inorganic binder is selected from the group consisting of aluminum oxide, silicon oxide, magnesium oxide, natural clay, and combinations thereof.

13. The catalytic composition according to claim 11, wherein a weight ratio of the inorganic binder to the acidic beta zeolite varies from 80:20 to 5:95.

14. The catalytic composition according to claim 11, which is characterized by an extra-zeolite porosity having a total volume greater than or equal to 0.80 ml/g and consisting for a fraction of at least 25% of pores having a radius greater than 100 Å.

15. The acidic beta zeolite according to claim 3, which is in the form of submicronic agglomerates of crystallites, wherein at least 90% of the crystallites have a dimension that is lower than 300 Å.

16. A catalytic composition comprising:
the acidic beta zeolite according to claim 3; and
an inorganic binder.

17. The catalytic composition according to claim 16, wherein the inorganic binder is selected from the group consisting of aluminum oxide, silicon oxide, magnesium oxide, natural clay, and combinations thereof.

18. The catalytic composition according to claim 16, wherein a weight ratio of the inorganic binder to the acidic beta zeolite varies from 80:20 to 5:95.

19. The catalytic composition according to claim 16, which is characterized by an extra-zeolite porosity having a total volume greater than or equal to 0.80 ml/g and consisting for a fraction of at least 25% of pores having a radius greater than 100 Å.

20. The acidic beta zeolite according to claim 4, which is in the form of submicronic agglomerates of crystallites, wherein at least 90% of the crystallites have a dimension that is lower than 300 Å.

21. A catalytic composition comprising:
the acidic beta zeolite according to claim 4; and
an inorganic binder.

22. The catalytic composition according to claim 21, wherein the inorganic binder is selected from the group consisting of aluminum oxide, silicon oxide, magnesium oxide, natural clay, and combinations thereof.

23. The catalytic composition according to claim 21, wherein a weight ratio of the inorganic binder to the acidic beta zeolite varies from 80:20 to 5:95.

24. The catalytic composition according to claim 21, which is characterized by an extra-zeolite porosity having a total volume greater than or equal to 0.80 ml/g and consisting for a fraction of at least 25% of pores having a radius greater than 100 Å.

25. A process for preparing the acidic beta zeolite of claim 1, which comprises crystallizing, in an aqueous environment, under hydrothermal conditions at a temperature ranging from 150 to 190° C., for a period of time ranging from 10 to 240 hours, a reagent mixture comprising, as aluminum source, sodium aluminate and an aluminum alkoxide or an inorganic salt of aluminum, a silica source selected from colloidal silica, tetraalkyl silicates and amorphous silica, and tetraethyl ammonium hydroxide as templating agent, said mixture having the following composition in terms of molar ratios:
$[SiO_2]/[Al_2O_3]$=10-30
[TEAOH]/$[SiO_2]$=0.10-0.35
$[H_2O]/[SiO_2]$=7-20
$[Na_2O]$/[TEAOH] greater than 0.1
[Na]/[Al] greater than 0.68 and lower than 1.00.

26. The process according to claim 25, wherein the mixture deriving from crystallization is filtered, the solid product obtained is subjected to ion exchange with an ammonium salt, and then dried and calcined.

27. The process according to claim 25, wherein the crystallization is carried out at a temperature ranging from 165 to 180° C., for a period of time ranging from 18 to 150 hours.

28. The process according to claim 25, wherein the aluminum alkoxide is selected from aluminum isopropylate or ter-butylate, the tetra-alkyl silicate is selected from tetramethyl- tetra-ethyl- or tetrapropyl-silicate, the aluminum inorganic salt is selected form nitrate and sulphate.

29. The process according to claim 25, wherein the reagent mixture has the following composition in terms of molar ratios:
$[SiO_2]/[Al_2O_3]$=10-25
[TEAOH]/$[SiO_2]$=0.15-0.30
$[H_2O]/[SiO_2]$=8-15
$[Na_2O]$/[TEAOH] greater than 0.1
[Na]/[Al] greater than 0.68 and lower than 1.00.

30. The process according to claim 26, wherein the suspension deriving from the crystallization, before being subjected to filtration, is acidified until a pH ranging from 3 to 6 is reached, and diluted with water in a ratio (volume of added water)/(volume of suspension) ranging from 1 to 10.

31. The process according to claim 26, wherein the solid product obtained from the filtration of the crystallization mixture is re-dispersed in water, subjected to an ion exchange treatment with an ammonium salt, filtered, dried at a temperature ranging from 100 to 200° C. for 8-16 hours and calcined at a temperature ranging from 450 to 650° C. for 4-8 hours.

32. A process for the alkylation of aromatic hydrocarbons which comprises putting an aromatic hydrocarbon in contact with an olefin selected from ethylene and propylene, in the presence of the acidic beta zeolite according to claim 1.

33. The process according to claim 32, carried out at a temperature ranging from 100 to 300° C. and at reaction pressures normally ranging from 1 to 100 bar.

34. The process according to claim 32, wherein the aromatic hydrocarbon is benzene.

35. The process according to claim 33, wherein the aromatic hydrocarbon is benzene, the olefin is propylene and the reaction is carried out at a temperature ranging from 100 to 200° C.

36. The process according to claim 35, carried out at a temperature ranging from 120 to 180° C.

37. The process according to claim 33, wherein the aromatic hydrocarbon is benzene, the olefin is ethylene and the reaction is carried out at a temperature ranging from 150 to 250° C.

38. The process according to claim 37, carried out at a temperature ranging from 170 to 230° C.

39. The process according to claim 33, carried out in at least partially liquid phase.

40. The process according to claim 39, carried out at a pressure ranging from 10 to 50 bar.

41. The process according to claim 32, wherein the molar ratio between the aromatic compound and the olefin fed to the reaction normally ranges from 1 to 30.

42. A process for the transalkylation of aromatic hydrocarbons which comprises putting an aromatic hydrocarbon in contact with one or more polyalkylated aromatic hydrocarbons, in the presence of the acidic beta zeolite according to claim 1.

43. The process according to claim 42, wherein the aromatic hydrocarbon is benzene.

44. The process according to claim 42, wherein the polyalkylated aromatic hydrocarbons are mixtures prevalently containing dialkylated aromatic hydrocarbons.

45. The process according to claim 42, wherein the polyalkylated aromatic hydrocarbon is selected from diethyl benzene, optionally in a mixture with triethyl benzene, and diisopropyl benzene, optionally in a mixture with triisopropyl benzene.

46. The process according to claim 42, carried out at a temperature ranging from 100 to 350° C.

47. The process according to claim 46, wherein the aromatic hydrocarbon is benzene, the polyalkylated aromatic hydrocarbons are polyisopropyl benzenes and the temperature ranges from 150 to 250° C.

48. The process according to claim 46, wherein the aromatic hydrocarbon is benzene, the polyalkylated aromatic hydrocarbons are polyethyl benzenes and the temperature ranges from 180 to 300° C.

49. The process according to claim 46, carried out under conditions of at least partially liquid phase.

50. The process according to claim 49, carried out under liquid phase conditions.

51. The process according to claim 49, carried out at a pressure ranging from 20 to 50 bar.

52. The process according to claim 42, wherein the molar ratio between the aromatic hydrocarbon and the sum of polyalkylated aromatic hydrocarbons varies from 1 to 40.

53. The process according to claim 52, wherein the molar ratio ranges from 3 to 30.

54. The process according to claim 32, which further comprises:

(a) putting an aromatic hydrocarbon in contact with an olefin selected from ethylene and propylene, in the presence of the acidic beta zeolite, under alkylation conditions;

(b) separating the product obtained into a fraction containing the aromatic hydrocarbon, a fraction containing the mono-alkylated aromatic hydrocarbon, a fraction containing polyalkylated aromatic hydrocarbons, prevalently containing dialkylated aromatic hydrocarbons, and a fraction of heavy aromatic hydrocarbons;

(c) putting the fraction containing polyalkylated aromatic hydrocarbons, prevalently containing dialkylated aromatic hydrocarbons, in contact with the aromatic hydrocarbon, in the presence of the acidic beta zeolite, under transalkylation conditions;

separating the product obtained from (c) into the same fractions obtained in (b), and subsequently recycling the fraction containing the aromatic hydrocarbon partly to (a) and partly to (c) and the fraction containing the polyalkylated aromatic hydrocarbons to (c).

55. The process according to claim 32, which is carried out in the presence of a catalytic composition comprising:

the acid beta zeolite; and an inorganic binder.

56. The process according to claim 55, wherein the catalytic composition is characterized by an extra-zeolite porosity having a total volume greater than or equal to 0.80 ml/g and consisting for a fraction of at least 25% of pores having a radius greater than 100 Å.

* * * * *